US010123602B2

(12) United States Patent
Morszeck

(10) Patent No.: US 10,123,602 B2
(45) Date of Patent: Nov. 13, 2018

(54) BAGGAGE ITEM WITH CORNER REINFORCEMENT

(71) Applicant: Rimowa GmbH, Cologne (DE)

(72) Inventor: Dieter Morszeck, Cologne (DE)

(73) Assignee: RIMOWA GmbH, Cologne (DE)

( * ) Notice: Subject to any disclaimer, the term of this patent is extended or adjusted under 35 U.S.C. 154(b) by 17 days.

(21) Appl. No.: 15/110,534

(22) PCT Filed: Jan. 20, 2015

(86) PCT No.: PCT/EP2015/050941

§ 371 (c)(1),
(2) Date: Jul. 8, 2016

(87) PCT Pub. No.: WO2015/107207

PCT Pub. Date: Jul. 23, 2015

(65) Prior Publication Data

US 2016/0338463 A1 Nov. 24, 2016

(30) Foreign Application Priority Data

Jan. 20, 2014 (EP) ..... 14151776

(51) Int. Cl.
*A45C 13/36* (2006.01)
*A45C 5/03* (2006.01)

(52) U.S. Cl.
CPC ..... *A45C 13/36* (2013.01); *A45C 5/03* (2013.01); *A45C 2005/037* (2013.01)

(58) Field of Classification Search
CPC ..... A45C 2005/037; A45C 13/36
USPC ..... 190/125, 127, 24, 35
See application file for complete search history.

(56) References Cited

U.S. PATENT DOCUMENTS

| | | | | | |
|---|---|---|---|---|---|
| 296,444 | A * | 4/1884 | Perkins | A45C 13/36 | 16/100 |
| 2,788,871 | A * | 4/1957 | Arlitt, Jr. | A45C 5/02 | 190/122 |
| 4,163,484 | A * | 8/1979 | Delaney | A45C 13/36 | 190/115 |
| 4,418,804 | A * | 12/1983 | Bradley | A45C 3/001 | 190/127 |

(Continued)

FOREIGN PATENT DOCUMENTS

| | | |
|---|---|---|
| FR | 2381685 A1 | 9/1978 |
| JP | 3146789 U | 12/2008 |
| WO | 00/59804 A1 | 10/2000 |

OTHER PUBLICATIONS

International Search Report and Written opinion of corresponding PCT/EP2015/050941 dated Apr. 24, 2015; 9 pgs.

(Continued)

*Primary Examiner* — Sue A Weaver
(74) *Attorney, Agent, or Firm* — Maier & Maier, PLLC

(57) ABSTRACT

In a baggage item, in particular a suitcase, having at least two baggage item portions, wherein the baggage item portions each have at least one baggage item wall having at least one baggage item wall inner face and at least one baggage item wall outer face, wherein at least one bag-gage item portion has at least one corner, it is intended that at the at least one corner of at least one baggage item portion a corner reinforcement is provided at the baggage item wall inner face.

9 Claims, 4 Drawing Sheets

(56) References Cited

U.S. PATENT DOCUMENTS

Figure 1:
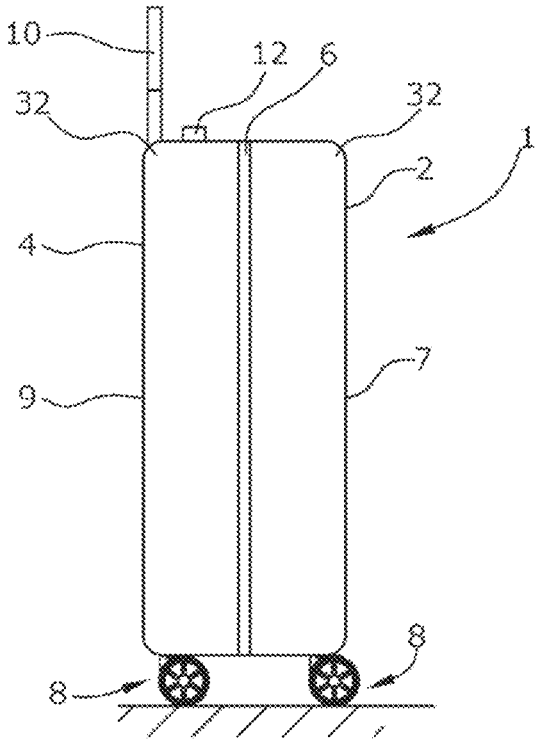

| | | | | |
|---|---|---|---|---|
| 4,703,519 | A * | 10/1987 | Krenzel | A45C 3/02 112/475.08 |
| 5,115,895 | A * | 5/1992 | Myers | A45C 5/02 190/123 |
| 5,794,744 | A * | 8/1998 | Lin | A45C 5/14 190/127 |
| 6,261,653 | B1 * | 7/2001 | Smith | B65D 81/054 206/453 |
| 9,066,566 | B2 * | 6/2015 | Lai | A45C 13/001 |
| 2007/0138041 | A1 * | 6/2007 | Welsh | A45C 13/36 206/349 |
| 2008/0295458 | A9 * | 12/2008 | Mostert | A45C 5/02 53/444 |
| 2012/0091025 | A1 | 4/2012 | Wyner et al. | |
| 2013/0213752 | A1 * | 8/2013 | Meersschaert | A45C 5/02 190/125 |
| 2014/0311847 | A1 * | 10/2014 | Hillaert | A45C 5/14 190/18 A |

OTHER PUBLICATIONS

Chinese Office Action dated Mar. 29, 2017, in connection with corresponding CN Application No. 201580004677.5 (6 pgs).
English translation of Korean Office Action dated Oct. 17, 2017 from corresponding Korean Application No. 10-2016-7017896 ( 5 pages).

* cited by examiner

BAGGAGE ITEM WITH CORNER REINFORCEMENT

The invention relates to a baggage item and to a method of manufacturing the baggage item according to the disclosure.

Baggage items, in particular hardshell suitcases, are known which comprise at least two baggage item portions. Each baggage item portion comprises at least one baggage item wall having at least one baggage item wall inner face and at least one baggage item wall outer face. At least one baggage item portion comprises at least one corner. Preferably, each baggage item portion comprises four corners.

There is an increasing demand for manufacturing ever lighter baggage items. On the other hand, these baggage items are to be very robust since the baggage items are subjected to many impacts and shocks during travel. Baggage items which have become lighter are disadvantageous in that they suffer from indentations and bulges in particular in the corners of the baggage item portions.

It is therefore an object of the present invention to provide a baggage item and to provide a method of manufacturing the baggage item, wherein the baggage item is very robust.

This object is achieved with the features of the disclosure.

It is intended in an advantageous manner that, at least at one corner of at least one baggage item portion, a corner reinforcement is provided at the baggage item wall inner face.

This offers the advantage that the baggage item is reinforced in the region where the baggage item is particularly susceptible to indentations or the like. The corner reinforcement comprises an inner face and an outer face, wherein the outer face of the corner reinforcement is attached to the baggage item wall inner face at the corner of the baggage item, wherein the contour of the outer face is adapted to the shape of the corner at the baggage item wall inner face.

This offers the advantage that the appearance of the baggage item is not changed. Further, the baggage item can continued to be manufactured as usual, and the corner reinforcement can be attached subsequently. The corner reinforcement may comprise a reinforcement contour at the inner face. This offers the advantage that particularly large forces can be absorbed by the corner reinforcement. A reinforcement contour may in particular increase the bending stiffness of the corner reinforcement and thus increase the bending stiffness of the corner of the baggage item portion. Thus indentations at the corner can be considerably reduced.

The shape of the reinforcement contour may be adapted to the forces acting in the corner during use of the baggage item. This offers the advantage that each baggage item may individually comprise an exactly adapted corner reinforcement having a correspondingly adapted reinforcement contour. Further, this offers the advantage that the reinforcement contour is adapted to the forces acting during use such that the reinforcement contour need not be overdimensioned. This offers the advantage that the reinforcement contour may also be very light and does not considerably increase the weight of the baggage item. The reinforcement contour may be defined by at least one rib-shaped raised portion at the inner face of the corner reinforcement.

The corner reinforcement may comprise at least one groove-shaped recess at the outer face at that site where the rib-shaped raised portion is arranged at the inner face. This offers the advantage that material and thus weight can be saved, wherein the reinforcement properties of the corner reinforcement are not reduced or only reduced to a negligible extent.

The corner reinforcement may comprise at least three rib-shaped raised portions at the inner face.

The corner reinforcement may comprise at least four rib-shaped raised portions at the inner face.

The outer face of the corner reinforcement may be glued to the baggage item wall inner face. Preferably, the outer face of the corner reinforcement may be glued to the baggage item wall inner face by hot gluing.

Further, according to the present invention, a method of manufacturing a baggage item with a corner reinforcement is provided, which comprises the following steps:

- manufacturing at least two baggage item portions each comprising a baggage item wall inner face and a baggage item wall outer face,
- manufacturing at least one corner reinforcement for at least one corner of at least one baggage item portion, wherein the corner reinforcement comprises a reinforcement contour at the inner face,
- fastening the at least one corner reinforcement to the baggage item wall inner face of the baggage item portion at the at least one corner of at least one baggage item portion.

The shape of the reinforcement contour may be adapted to the forces occurring in the corner during use of the baggage item.

The reinforcement contour may be defined by at least on rib-shaped raised portion at the inner face of the corner reinforcement.

The corner reinforcement may be manufactured by injection molding. The corner reinforcement may be glued to the baggage item wall inner face, wherein the gluing is preferably performed by hot gluing.

Figure 2:
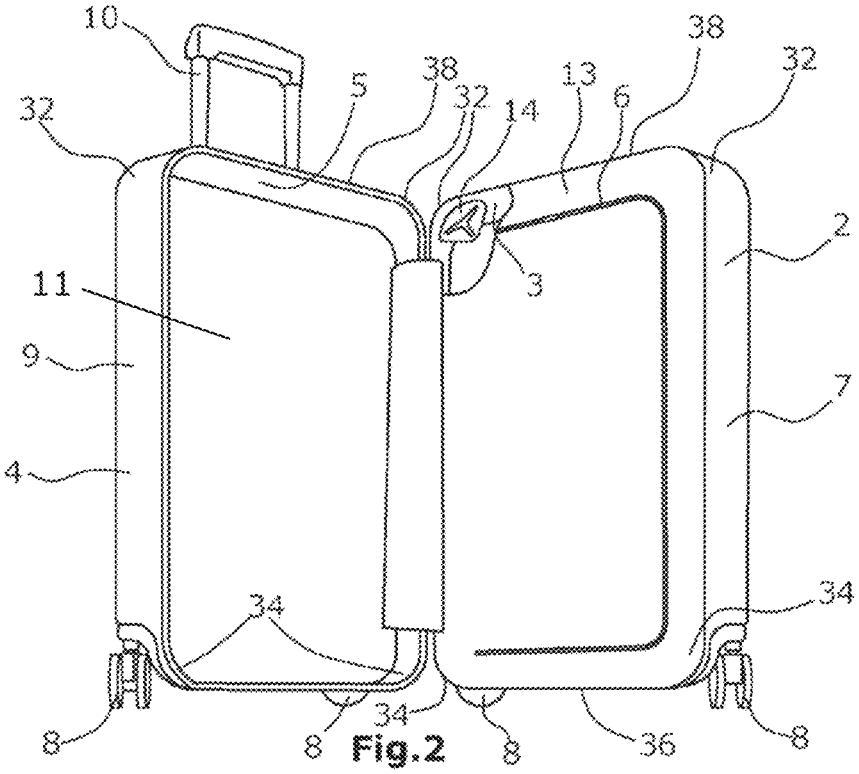
Figure 3:
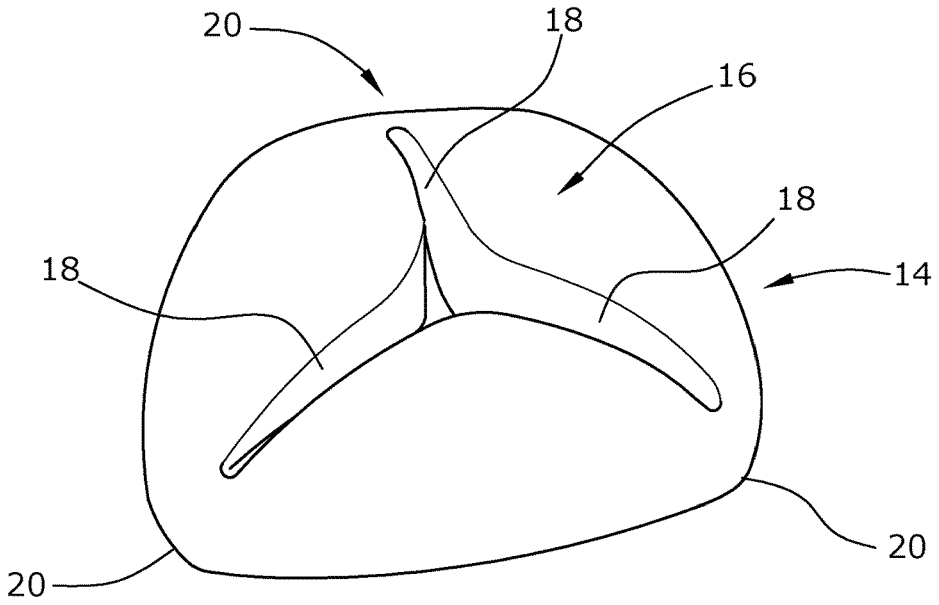
Figure 4:
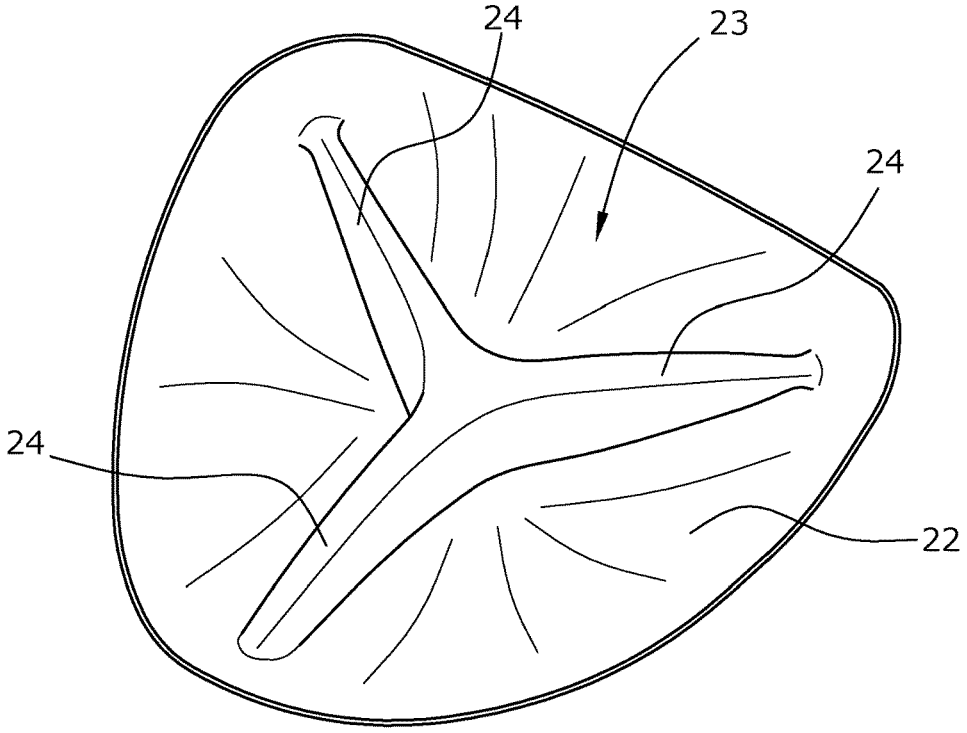
Figure 5:
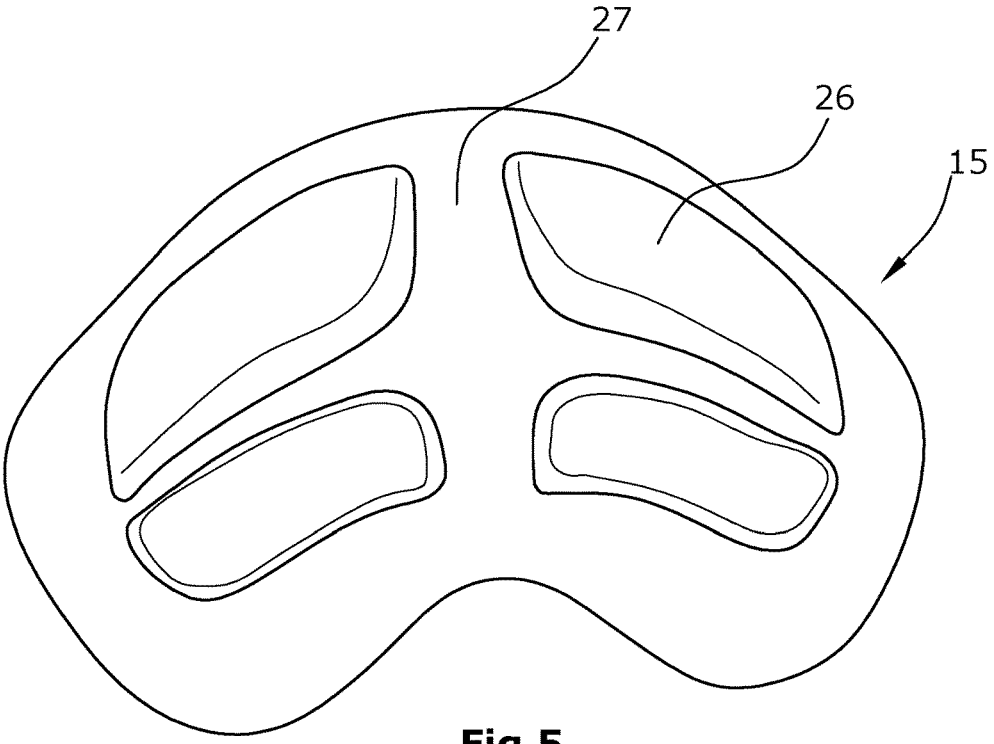
Figure 6:
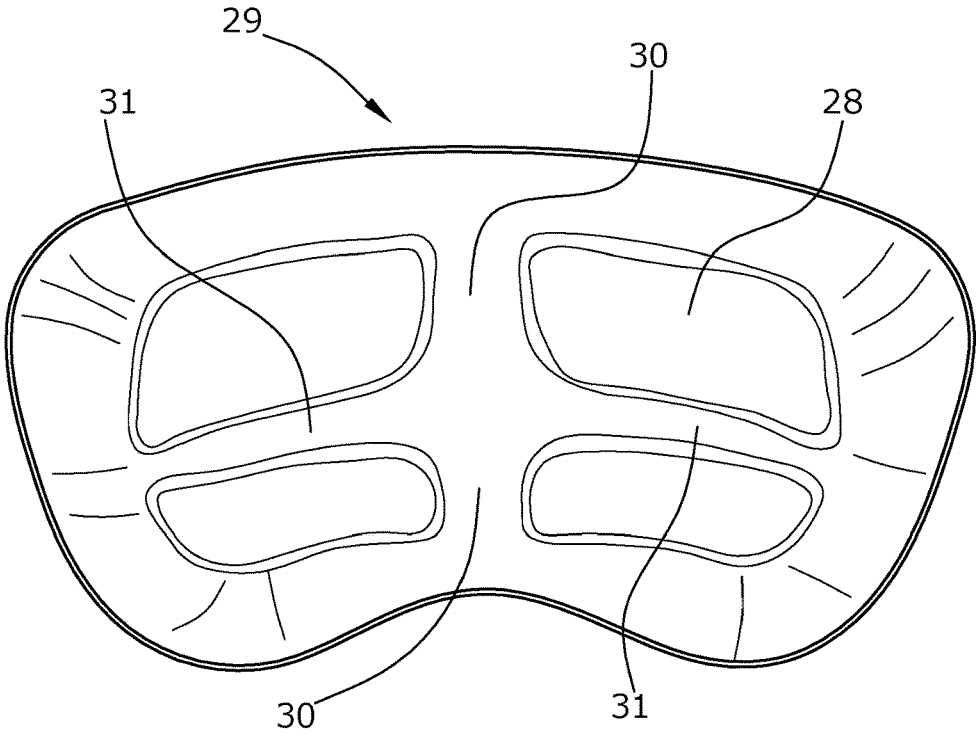
Figure 7A:
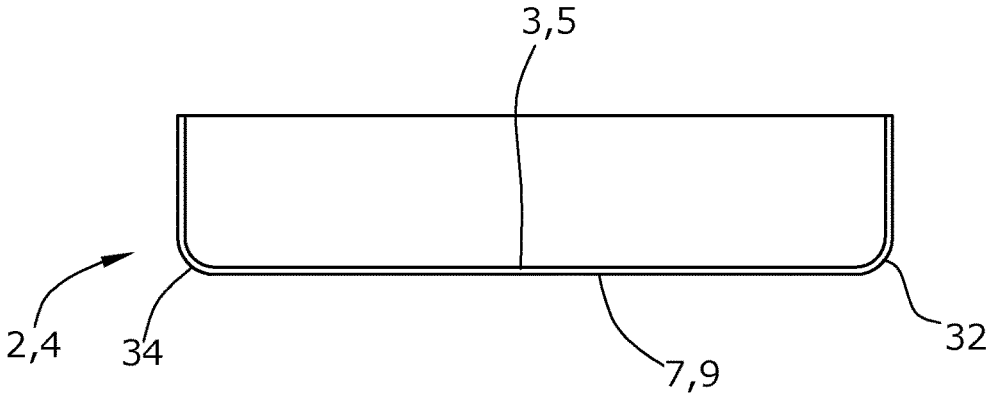
Figure 7B:
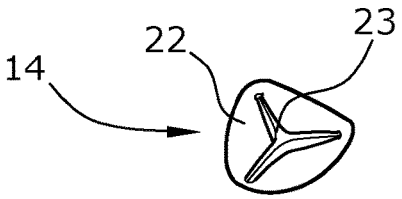
Figure 7C:
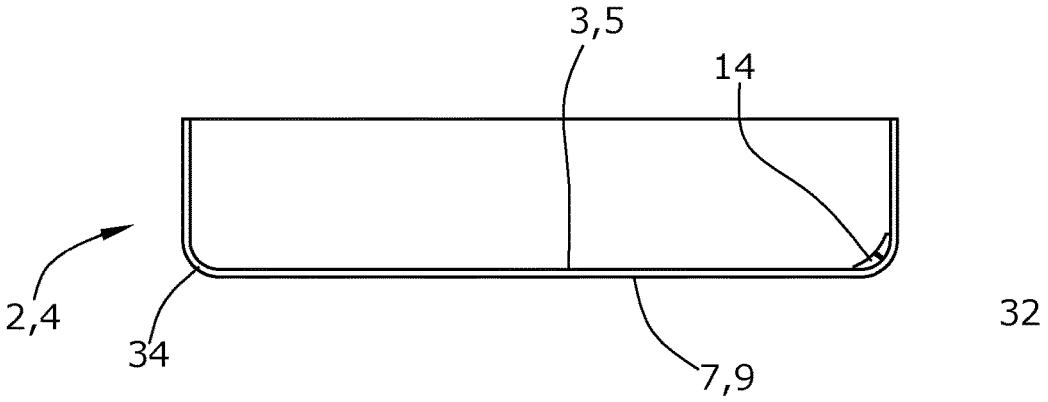

Hereunder the invention is described in detail with reference to the drawings in which:

FIG. 1 schematically shows a baggage item,

FIG. 2 schematically shows the open baggage item of FIG. 1,

FIG. 3 schematically shows a corner reinforcement,

FIG. 4 schematically shows the corner reinforcement of FIG. 3 looking at the inner face, FIG. 5 schematically shows an alternative corner reinforcement, FIG. 6 schematically shows the corner reinforcement of FIG. 5 looking at the inner face, FIGS. 7*a*-7*c* schematically show steps of the method of manufacturing the baggage item.

FIG. 1 shows a baggage item 1. The baggage item 1 may be a suitcase, in particular a hardshell suitcase, as in the illustrated exemplary embodiment. The baggage item 1 comprises a first baggage item portion 2 and a second baggage item portion 4. The baggage item portions 2, 4 are connected with each other via a zip fastener 6. The baggage item 1 further comprises castors, in particular swivel castors, by means of which the baggage item 1 is adapted to be moved on a floor. Further, the baggage item 1 comprises a telescopic handle 10 and a grab handle 12. The respective baggage item portions 2, 4 each comprise a baggage item wall having a baggage item wall inner face 3, 5 and a baggage item wall outer face 7, 9. The baggage item 1 further comprises corners 32 and 34. The corners 34 are arranged at the lower end 36 of the baggage item. At each corner 34, a castor 8 is arranged. At the upper end 38 of the baggage item the corners 32 are arranged.

In FIG. 2 the baggage item 1 of FIG. 1 is shown in its open state. Inside, the baggage item comprises a lining fabric 11 and partitioning means 13. In FIG. 2 a portion of the partitioning means 13 and the lining fabric 11 is not shown so that a portion of the baggage item wall inner face 3 at a corner 32 can be seen.

As is shown in FIG. 2, a corner reinforcement 14 is arranged at the baggage item wall inner face 3 at the corner 32. A corner reinforcement 14 is arranged at least at one corner 32, but preferably at all corners 32.

The corner reinforcement 14 is shown in greater detail in FIGS. 3 and 4.

The corner reinforcement 14 comprises an outer face 16. The outer face 16 is preferably adapted to the contour of the corner 32 at the baggage item wall inner face 3. The corner reinforcement 14 is preferably fastened, in particular glued, by the outer face 16 to the baggage item wall inner face 3 at the corner 32.

The corner reinforcement 14 further comprises a reinforcement contour 23 at the inner face 22. The reinforcement contour 23 is adapted to the forces acting in the corner 32 during use of the baggage item 1 such that the corner 32 is reinforced by means of the reinforcement contour of the corner reinforcement 14 and the forces can be absorbed.

In the illustrated exemplary embodiment, the reinforcement contour 23 is defined by the rib-shaped raised portions 24. In the exemplary embodiment illustrated in FIGS. 3 and 4 the corner reinforcement 14 comprises three rib-shaped raised portions 24 which are offset relative to each other at an angle of approximately 120°. The height and the shape of the rib-shaped raised portions 24 are adapted to the amount of the forces acting in the corner 32 during use. The corner reinforcement illustrated in FIGS. 3 and 4 comprises three corners 20.

The forces occurring during handling or use may be determined by means of drop tests, for example, wherein the baggage item is dropped from a predefined height onto a floor. With the aid of a computer program which applies e.g. the finite element method, the shape and the number of the rib-shaped raised portions and thus the shape of the reinforcement contour may be determined. However, the reinforcement contour is not limited to rib-shaped raised portions.

At the outer face 16 of the corner reinforcement 14, groove-type recesses 18 may be arranged at that site where the rib-shaped raised portions 24 are arranged at the inner face 22. In the illustrated exemplary embodiment, the groove-shaped recesses 18 are provided by the rib-shaped raised portions 24 being hollow and not closed at the outer face 16.

The groove-type recesses 18 offer the advantage that material can be saved without the reinforcing properties of the corner reinforcement being reduced or limited since the groove-shaped recesses 18 are arranged at the outer face 16 at those sites where the rib-shaped raised portions 24 are disposed at the inner face 22. Further, the corner reinforcement 14 is easier to manufacture due to provision of the groove-shaped recess 18. Thus the corner reinforcement may be manufactured by deep drawing. However, the corner reinforcements 14 are preferably manufactured by injection molding.

In FIGS. 5 and 6 an alternative corner reinforcement is illustrated. This corner reinforcement 15 is provided as corner reinforcement of an alternative baggage item 1 which, however, comprises the same elements as the baggage item 1 described in FIGS. 1 and 2. However, the baggage item 1 has a different size and width such that different forces act in the corners 32 during handling or use of the baggage item. Thus, an alternative corner reinforcement 15 is obtained. The corner reinforcement 15 shown in FIGS. 5 and 6 also comprises an outer face 26 which is adapted to the baggage item wall inner face 3 of a baggage item 1.

The corner reinforcement 15 also comprises a reinforcement contour 29 at its inner face 28. The reinforcement contour 29 comprises four rib-shaped projections 30, 31. The rib-shaped projections 30 are wider than the rib-shaped projections 31. The reinforcement contour 29 of the corner reinforcement 15 is also adapted to the forces acting at the corresponding corner in the corresponding baggage item. In the present case, accordingly, the reinforcement contour comprises four rib-shaped projections 30, 31, wherein two of the rib-shaped projections are wider than the other two rib-shaped projections 31. At the outer face 26 of the corner reinforcement 15, too, groove-shaped recesses 27 are arranged at those sites where the rib-shaped projections 30, 31 are disposed. They offer the same advantage as the rib-shaped recesses 18 of the corner reinforcement 14.

In FIGS. 7*a* to 7*c*, manufacturing steps of the method of manufacturing the baggage item with at least one corner reinforcement are illustrated. FIG. 7*a* illustrates how to manufacture at least two baggage item portions 2, 4. For the sake of better survey, FIG. 7*a* merely shows one baggage item portion. The baggage item portions 2, 4 each comprise a baggage item wall inner face 3, 5 and a baggage item wall outer face 7, 9. Further, as illustrated in FIG. 7*b*, at least one corner reinforcement for at least one corner of a baggage item portion 2, 4 is manufactured. The corner reinforcement 14 comprises a reinforcement contour 23 at the inner face 22. The shape of the reinforcement contour is preferably adapted to the forces occurring in the corner 32 during use of the baggage item 1. The reinforcement contour may be defined by rib-shaped raised portions, for example.

FIG. 7*c* illustrates that the at least one corner reinforcement 14 has been fastened to the baggage item wall inner face 3, 5 of the baggage item portion 2, 4 at the at least one corner 32 of the at least one baggage item portion 2, 4. The corner reinforcement 14 is preferably glued to the baggage item wall inner face 3, 5, wherein the corner reinforcement 14 is preferably glued to the baggage item wall inner face 3, 5 by hot gluing.

The corner reinforcement 14 may be the corner reinforcement illustrated in FIGS. 3 and 4, for example. Further, the method of manufacturing the baggage item 1 may comprise further steps such as e.g. connecting the two baggage item portions by means of a zip fastener or the like, attaching the telescopic handle 10 and the grab handle 12, applying the lining fabric 11 and the partitioning means 13 as well as attaching the castors, in particular swivel castors 8, at the corners 34. In addition, the method may comprise further steps not mentioned here.

The invention claimed is:

1. A suitcase, comprising:

at least two baggage item portions, wherein said baggage item portions each comprise at least one baggage item wall having at least one baggage item wall inner face and at least one baggage item wall outer face, wherein at least one baggage item portion comprises at least one corner, wherein at said at least one corner of at least one baggage item portion a corner reinforcement is provided at said baggage item wall inner face;

wherein the corner reinforcement comprises a reinforcement contour at an inner face, and wherein the reinforcement contour is defined by at least one rib-shaped raised portion at the inner face of the corner reinforcement.

2. The suitcase according to claim 1, wherein an outer face of said corner reinforcement is attached to the baggage item wall inner face at the corner of the baggage item portions, wherein the contour of said outer face is adapted to the shape of said corner at said baggage item wall inner face.

3. The suitcase according to claim 2, wherein the corner reinforcement comprises at least one groove-shaped recess at the outer face at that site where the rib-shaped raised portion is arranged at the inner face.

4. The suitcase according to claim 2, wherein the corner reinforcement comprises at least three rib-shaped raised portions at the inner face.

5. The suitcase according to claim 2, wherein the corner reinforcement comprises at least four rib-shaped raised portions at the inner face.

6. The suitcase according to claim 2, wherein the outer face of the corner reinforcement is glued to the baggage item wall inner face, preferably by hot gluing.

7. A method of manufacturing a suitcase with at least one corner reinforcement, comprising:

manufacturing at least two baggage item portions each comprising a baggage item wall having a baggage item wall inner face and a baggage item wall outer face, manufacturing at least one corner reinforcement for at least one corner of at least one baggage item portion, wherein said corner reinforcement comprises a reinforcement contour at an inner face, fastening said at least one corner reinforcement to said baggage item wall inner face of said baggage item portion at said at least one corner of at least one baggage item portion, wherein the reinforcement contour is defined by at least one rib-shaped raised portion at the inner face of the corner reinforcement.

8. The method according to claim 7, wherein the shape of the reinforcement contour is adapted to the forces occurring in the corner during use of the baggage item.

9. The method according to claim 7, wherein the corner reinforcement is glued to the baggage item wall inner face, wherein the gluing is performed by hot gluing.

* * * * *